US009284824B2

(12) United States Patent
Fadul et al.

(10) Patent No.: US 9,284,824 B2
(45) **Date of Patent: *Mar. 15, 2016**

(54) METHOD AND APPARATUS FOR EXPENDABLE TUBING-CONVEYED PERFORATING GUN

(71) Applicant: HALLIBURTON ENERGY SERVICES, INC., Houston, TX (US)

(72) Inventors: Javier Fadul, Spring, TX (US); Paul Herman, Plano, TX (US); Paul Ringgenberg, Frisco, TX (US); Randy Moore, Carrollton, TX (US); Michael Fripp, Carrollton, TX (US); Dennis Crowdis, Denton, TX (US); John Hales, Frisco, TX (US); Bryan Powell, Corinth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 176 days.

This patent is subject to a terminal disclaimer.

(21) Appl. No.: 14/047,355

(22) Filed: Oct. 7, 2013

(65) Prior Publication Data

US 2014/0034384 A1 Feb. 6, 2014

Related U.S. Application Data

(63) Continuation of application No. PCT/US2012/034599, filed on Apr. 22, 2012.

(60) Provisional application No. 61/477,910, filed on Apr. 21, 2011.

(51) Int. Cl.
*E21B 43/117* (2006.01)
*E21B 43/116* (2006.01)

(52) U.S. Cl.
CPC ..... *E21B 43/116* (2013.01); *E21B 43/117* (2013.01)

(58) Field of Classification Search
CPC ..... E21B 43/116; E21B 7/14
See application file for complete search history.

(56) References Cited

U.S. PATENT DOCUMENTS 4,467,878 A 8/1984 Ibsen
5,829,538 A 11/1998 Wesson et al.

(Continued)

FOREIGN PATENT DOCUMENTS

WO 9946476 9/1999

OTHER PUBLICATIONS

D.J. Branagan, Y.L. Tang, A.V. Sergueeva, A.K. Mukherjee, "Low Temperature Superplasticity in a Nanocomposite Iron Alloy Derived from a Metallic Glass," Nanotechnology, vol. 14, No. 11, 2003, 12 pages.

(Continued)

*Primary Examiner* — William P Neuder
(74) *Attorney, Agent, or Firm* — Chamberlain Hrdlicka

(57) ABSTRACT

Methods and apparatus are presented for a "disappearing" perforator gun assembly. In a preferred method of perforating a well casing, inserted into the well casing is a tubing conveyed perforator having an outer tubular made from a metallic glass alloy having high strength and low impact resistance. An inner structure is positioned within the outer tubular and holds one or more explosive charges. Upon detonating the explosive charges, the outer tubular is fragmented. The inner structure is preferably also substantially destroyed upon detonation of the one or more explosive charges. For example, the inner structure can be made from a combustible material, corrodible, dissolvable, etc., material. A disintegration-enhancing material is optionally positioned between the outer tubular and the inner structure. Additional embodiments are presented having gun housings which dematerialize upon detonation of the charges.

25 Claims, 9 Drawing Sheets

(56) References Cited

U.S. PATENT DOCUMENTS

| | | | | |
|---|---|---|---|---|
| 5,960,894 | A * | 10/1999 | Lilly et al. | 175/4.6 |
| 6,767,419 | B1 | 7/2004 | Branagan | |
| 2002/0134585 | A1 | 9/2002 | Walker | |
| 2008/0149345 | A1 | 6/2008 | Marya et al. | |
| 2010/0300750 | A1 | 12/2010 | Hales et al. | |

OTHER PUBLICATIONS

Written Opinion of PCT Application No. PCT/US2012/034599 dated Dec. 17, 2012: pp. 1-12.

* cited by examiner

METHOD AND APPARATUS FOR EXPENDABLE TUBING-CONVEYED PERFORATING GUN

CROSS-REFERENCE TO RELATED APPLICATIONS

This application is continuation of PCT International Application No. PCT/US2012/034599, filed on Apr. 22, 2012, which claims benefit of U.S. Provisional Application Ser. No. 61/477,910, filed on Apr. 21, 2011. Each patent application identified above is herein incorporated in its entirety by reference for all purposes.

FIELD OF INVENTION

The invention relates, in general, to a method and apparatus for perforating wells, and more particularly to an expendable tubing conveyed perforator assembly.

BACKGROUND OF INVENTION

Without limiting the scope of the present invention, its background will be described with reference to perforating a hydrocarbon bearing subterranean formation with a shaped-charge perforating apparatus.

Two primary methods are extensively used to perform tubing-conveyed perforation (TCP) operations in the oil and gas recovery industry. A typical TCP assembly comprises an inner metallic tubular on which are mounted a plurality of shaped-charge explosives, positioned within an outer metallic tubular which acts as a housing, protective covering, fluid isolation, and tension and radial load bearing structure. The assembly includes detonation cords, etc., as are known in the art. The shaped charges, when fired, perforate the outer tubular, the casing (if present), and the formation. The outer and inner tubulars are often severely damaged, fragmented and misshapen during the process. The outer tubular, now perforated, often has projections extending at the circumferences of the perforations.

In one of the primary methods currently in use, any remaining portion of the TCP assembly, after firing, is pulled out of the casing and can be reloaded with charges and reused, if intact. However, this method has several disadvantages since in many drilling situations the inner tubular on which the shaped charges are mounted is damaged to such a degree that it cannot be removed from the hole without destroying the well.

The other method used in the industry is to utilize expendable TCP perforators to fire the charges. Following firing, the expendable perforating system is dropped to the bottom of the drilled hole that extends below the targeted formation, that is, into the rathole. However, drilling the rathole portion of the well requires additional drilling to depths as much as 2,000 feet beyond the target area so that the expended perforator can be accommodated. This extra drilling results in considerable additional time and drilling costs. In addition, the conventional metal tubing used for the TCP assembly generally fragments into large pieces of debris upon firing of the charges. These large pieces of metal debris often cause problems in fluid extraction, such as jamming of equipment, preventing tube removal, inhibiting fluid flow, contaminating the fluid, or clogging pumps or tubing used to extract the fluid.

Thus an expendable TCP assembly is needed which reduces these problems. The purpose of this invention is to develop a tubing conveyed perforator that does not require substantial additional rathole drilling and reduces the potential to clog oil extraction equipment with debris.

SUMMARY OF THE INVENTION

Methods and apparatus are presented for a "disappearing" perforator gun assembly. In a preferred method of perforating a well casing, inserted into the well casing is a tubing conveyed perforator having an outer tubular made from a metallic glass alloy having high strength and low impact resistance. An inner structure is positioned within the outer tubular and holds one or more explosive charges. Upon detonating the explosive charges, the outer tubular is fragmented. The inner structure is preferably also substantially destroyed upon detonation of the one or more explosive charges. For example, the inner structure can be made from a combustible material, corrodible, dissolvable, etc., material. Exemplary metallic glass alloys are $Zr_{41.25}$ $Ti_{13.75}$ $Ni_{10}$ $Cu_{12.5}$ $Be_{22.5}$, $Mg_{65}$ $C_{25}$ $Tb_{10}$, *and* $Fe_{59}$ $Cr_6$ $Mo_{14}$ $C_{15}$ $B_6$. A disintegration-enhancing material is optionally positioned between the outer tubular and the inner structure.

Additional embodiments are presented having corrodible, dissolvable, reactive, meltable, etc., outer tubulars and inner structures.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear. Upstream and downstream are used to indicate location or direction in relation to the surface, where upstream indicates relative position or movement towards the surface along the wellbore and downstream indicates relative position or movement further away from the surface along the wellbore.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention. The description is provided with reference to a vertical wellbore; however, the inventions disclosed herein can be used in horizontal, vertical or deviated wellbores.

As described above, the invention is drawn to an expendable tubing conveyed perforator comprising an outer tubular made from a metallic glass alloy having high strength and low impact resistance and an inner structure made from a combustible material, the inner structure supporting one or more explosive charges. The present invention overcomes problems with prior art TCPs in that substantially all of the outer tubular is fragmented upon detonation, and the inner structure is combustibly consumed upon detonation. Thus, the expendable TCP of the present invention does not require that an extended rathole be prepared, nor depressurization of the well system for perforator removal. In addition, due to the highly frangible nature of the materials used to make the outer tubular of the TCP of the present invention, the pieces produced after detonation of the expendable TCP are less likely to inhibit fluid flow or clog the extraction equipment.

Figure 1:
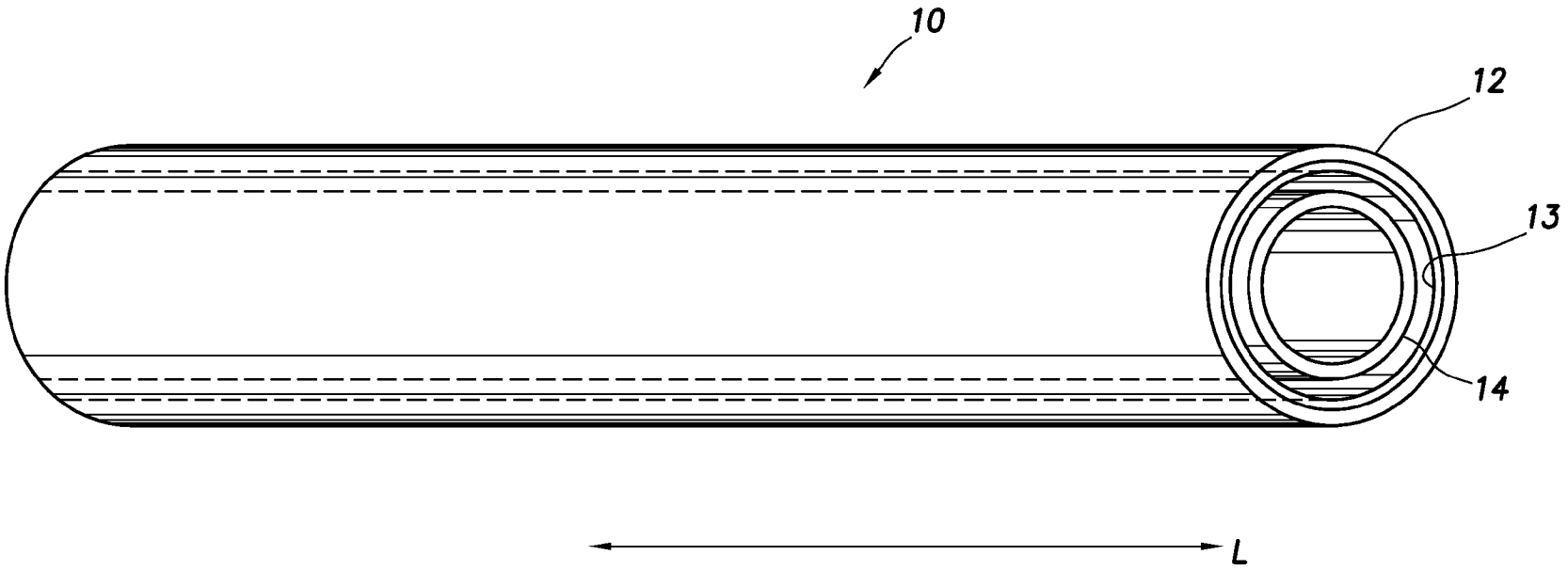
FIG. 1 is a side view of an expendable tubing conveyed perforator of the invention.

FIG. 1 shows the expendable tubing conveyed perforator 10 of the invention. According to the invention, the outer tubular 12 of the expendable tubing conveyed perforator is made from a metallic glass alloy having high strength and low impact resistance. As used herein, the phrase "high strength and low impact resistance" refers to tensile strengths in the range from approximately 200 to approximately 1000 ksi, moduli from approximately 20 to approximately 150 Msi, and elongations from approximately 0.2 to approximately 3 percent, all parameters being measured at room temperature.

The thickness of the outer tubular 12 is preferably thin enough such that the tube fragments into small pieces upon detonation, yet thick enough to provide structural integrity and protection to the inner structure. Preferably, the outer tubular possesses sufficient axial tensile strength necessary to support the vertical combined weight of the system when situated in the well hole. The outer tubular preferably also possesses sufficient axial compression strength required to move the TCP unit around bends or maintain a non-vertical position. It will be appreciated that the thickness of the outer tubular will vary depending on parameters of the metallic glass alloy, the selected tool design, the shaped charges, the specific application and result required, etc. These parameters are well-known to those skilled in the art.

The outer tubular portion 12 of the present invention should also be able to withstand the environmental conditions encountered in a well hole at 1,000-40,000 feet. Generally, these conditions include temperatures in the range of about 200 degrees to about 350 degrees Fahrenheit, pressures in the range of about 6,000 to 20,000 psi, and exposure to corrosive and/or noxious chemicals such as hydrogen sulfide, calcium hydroxide, and carbon dioxide.

The frangible nature of the metallic glass alloys used to construct the outer tubular results in high fragmentation of the outer tubular upon detonation of the explosive charges. Preferably, the outer tubular is fragmented into pieces less than about 4 inches, more preferably less than about 1 inch, and most preferably less than about 0.1 inches. The outer tubular can be made of a single or a combination of metallic glass alloys. The outer tubular may not be entirely made of metallic glass alloy.

Figure 2:
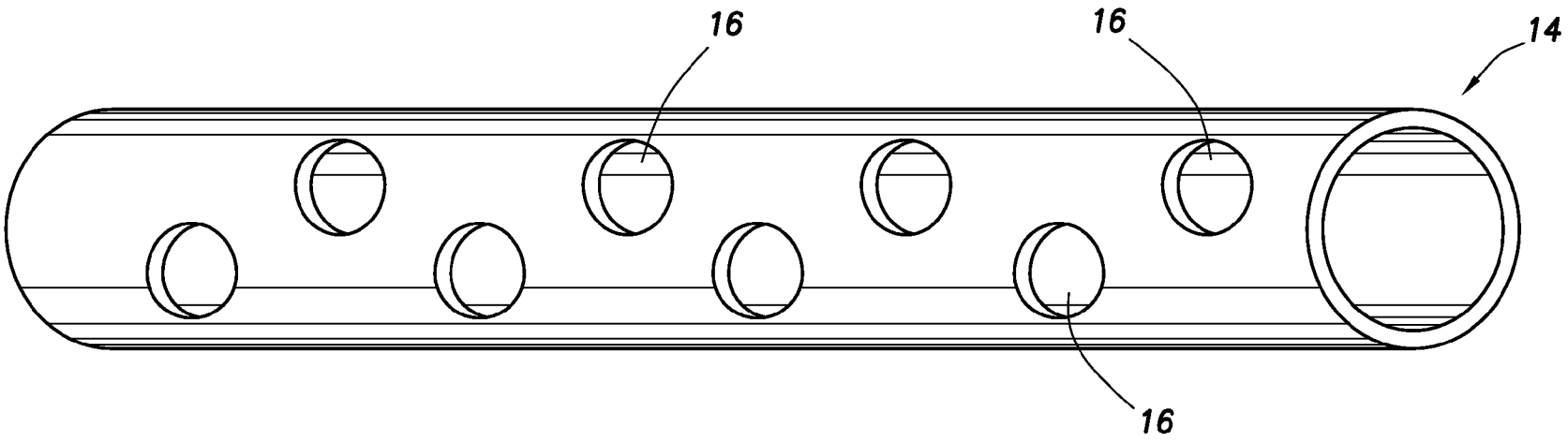
FIG. 2 is a side view of an inner structure of the expendable tubing conveyed perforator of the invention.
Figure 3:
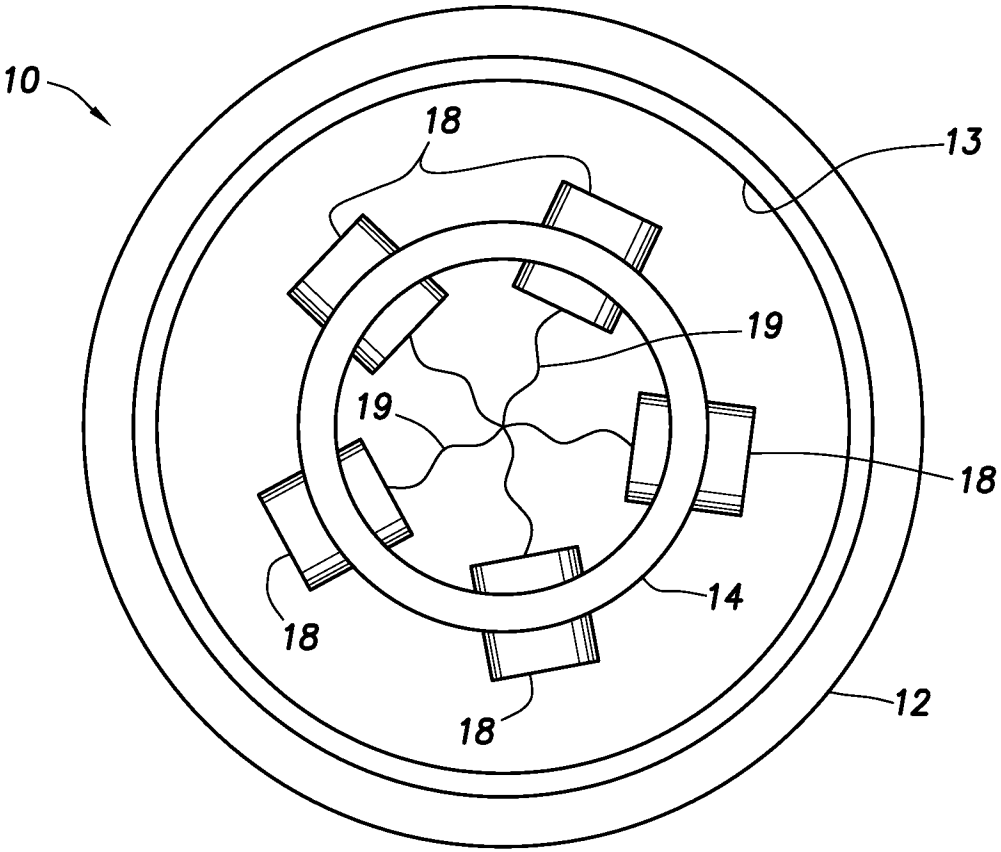
FIG. 3 is an end view of an expendable tubing conveyed perforator of the invention.

According to the invention, the inner structure 14 is positioned within the outer tubular and preferably parallel to the longitudinal axis L of the outer tubular 12 as shown in FIG. 1. As shown in FIGS. 2 and 3, the inner structure 14 is preferably tubular with holes 16 or other mounting structures that can accommodate the shaped explosive charges 18. Generally, shaped charges that are useful in the expendable TCP of the invention are well known in the art and are available commercially. As shown in FIG. 3, the shaped charges 18 are connected by primer cords 19 so that they may be simultaneously detonated.

The inner structure 14 of the invention is made from a combustible structural material such as nitrocellulose, wood cellulose, cardboard, fiberboard, thermoplastic, thermoset resin, thin gauge metals, structural foam, and the like. The materials used to manufacture the inner structure 14 are combustible upon detonation of the explosive charges, and following detonation, the material that makes up the inner structure is substantially combustibly consumed, leaving only ash and minor residue.

An optional tubular layer of disintegration-enhancing material 13 may be positioned within the outer tubular 12 and parallel to the longitudinal axis L of the outer tubular 12 as shown in FIGS. 1 and 3. The tubular layer of disintegration enhancing material 13 is positioned within the annular space between the outer surface of the inner structure 14 and the inner surface of the outer tubular 12, and preferably just adjacent to the inner surface of the outer tubular 12. The disintegration-enhancing material 13 is preferably made from a combustible material such as nitrocellulose, wood cellulose, cardboard, fiberboard, thermoplastic, thermoset resin, foam, paint, and the like. The disintegration-enhancing material 13 is combustible upon detonation of the explosive charges, and following detonation is substantially combustibly consumed, leaving only ash and minor residue.

Unlike the inner structure 14, the optional disintegration-enhancing material 13 is not required to possess extensive structural capability. Upon combustion, the optional disintegration-enhancing material 13 provides additional energy to aid in disintegrating frangible outer tubular 12 into small pieces.

Figure 4:
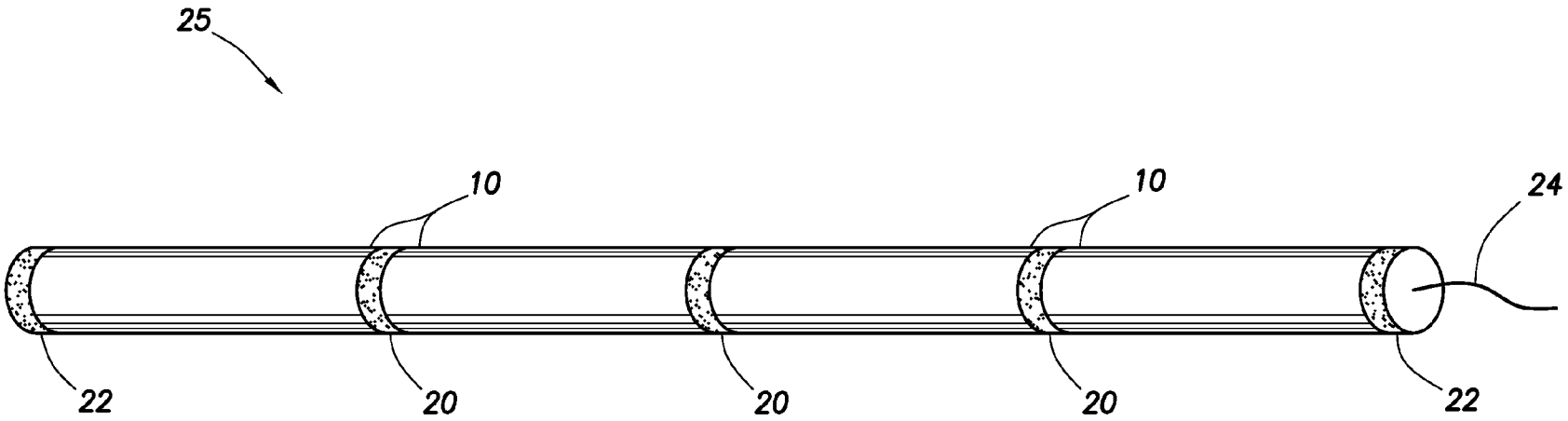
FIG. 4 is a side view of an alternative embodiment of the expendable tubing conveyed perforator of the invention.

The expendable tubing conveyed perforator 10 of the invention may be combined in sections to produce a longer perforator unit 25 as shown in FIG. 4. As shown in FIG. 4, each perforator 10 is connected to the next perforator by a connector 20 and held in place with an adhesive, such as an epoxy adhesive or threaded interface, pins, integrated entrapment, or a combination of these attaching means. The connectors 20 may be made from materials such as steel, or the same frangible materials as the outer tubular 12 so that the connectors are also highly fragmented upon detonation. End plugs 22 are used to cap the ends of the perforator unit 25 and are also held in place with an adhesive, threaded interface, pins, integrated entrapment, or a combination of these. Like the connectors 20, the end plugs 22 may also be made from steel or the same frangible materials used to make the outer tubular 12. The primer cord 24 for the perforator unit 25 extends out the top of one of the end plugs 22 and may be connected to conventional detonating equipment known in the art.

In use, the expendable tubing conveyed perforator is lowered into the well casing to the desired depth and detonated using conventional procedures. The frangible nature of the metallic glass alloys of the outer tubular cause it to fragment upon detonation into a multitude of small pieces, preferably less than about 3 inches in size. Concomitantly, the combustible material that makes up the inner structure is substantially combustibly consumed leaving only minor amounts of ash and residue. The small fragmented pieces of the outer tubular either fall to the bottom of the well and, due to their small size, compact into a small volume in the "rathole" portion of the well, or pumped out of the well at a later time. Thus, shorter ratholes are required when utilizing the expendable TCP of the invention as compared with TCPs of the prior art. In addition, the small pieces of fragmented outer tubular and minor residue generated from combustion of the inner structure substantially reduce the chance of clogging the well or oil extracting equipment. Thus, the present invention, and method of use, eliminates post-fire perforator gun removal by extraction or discarding into a rathole.

The design of the gun system is basically the same as the one disclosed in U.S. Pat. No. 5,960,894, to Lilly, filed Mar. 18, 1998, with a significant difference being the material used to construct the outer hollow carrier.

The outer tubular 12 may be made by a conventional metallic glass alloy manufacturing process. The thickness of the outer tubular 12 is preferably thin enough such that the tubular fragments into small pieces upon detonation, yet thick enough to provide structural integrity and protection to the inner structure. Metallic glasses, as detailed below, can be much stronger than conventional alloys, such as steel. This characteristic is beneficial to the design of the system because the outer tubular can be made to have a thinner wall than a conventional steel carrier while still guaranteeing the structural integrity of the system. At the same time, a thinner outer tubular wall should shatter more easily and into smaller pieces. Preferably, the outer tubular possesses sufficient axial tensile strength necessary to support the vertical combined weight of the system when situated in the well hole. The outer tubular preferably also possesses sufficient axial compression strength required to move the TCP unit around bends or maintain a non-vertical position. The outer tubular portion 12 should also be able to withstand the high-pressure and high-temperature environmental conditions encountered in a well and exposure to corrosive and/or noxious chemicals such as hydrogen sulfide, calcium hydroxide, and carbon dioxide.

The optional tubular layer of disintegration-enhancing material 13 may be positioned between the outer tubular 12 and the inner structure 14. Unlike the inner structure 14, the disintegration-enhancing material 13 is not required to possess extensive structural capability. Upon combustion, the optional disintegration-enhancing material 13 provides additional energy to aid in disintegrating frangible outer tubular 12 into small pieces. This material 13 will also be consumed by combustion upon detonation leaving only ash and minor residue.

Figure 5:
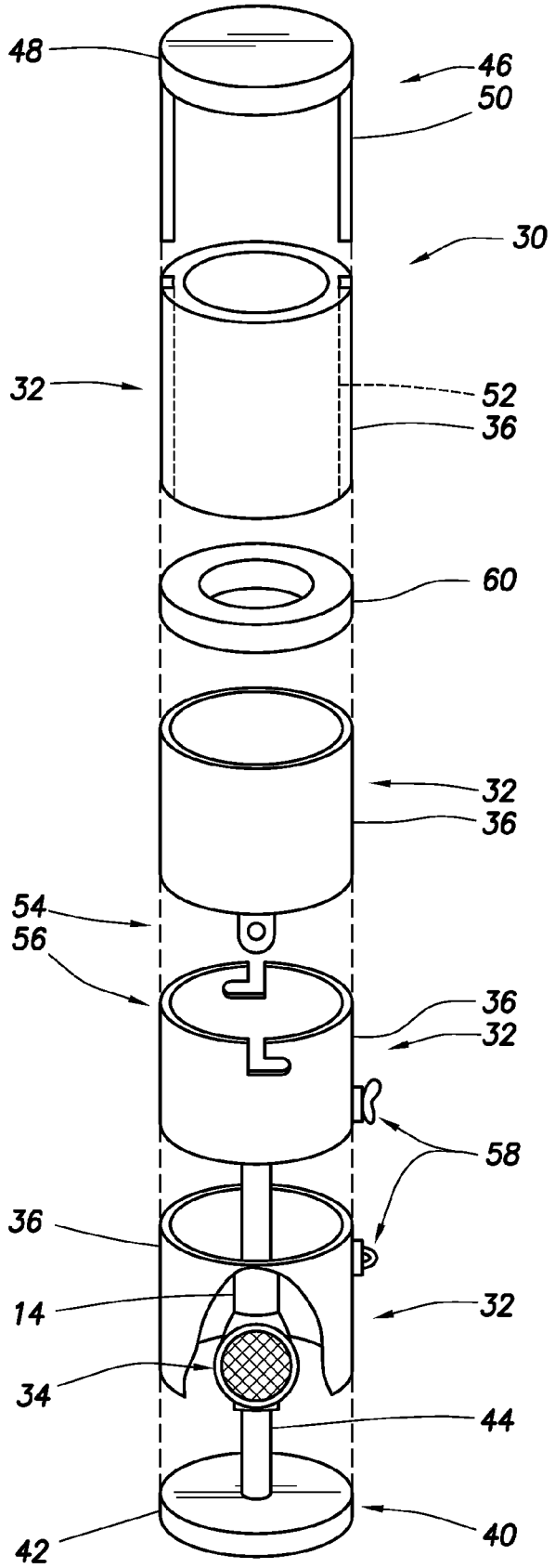
FIG. 5 is an elevational exploded view, with cut-away, showing an alternative embodiment of an expendable tubing conveyed perforator of the invention.

As making large sized items can be more difficult with metallic glass alloys, another embodiment of the TCP 30, an example of which is seen at FIG. 5, comprises individual charge holding sections 32, each section 32 holding just one or two charges 34. These sections would effectively be hollow boxes. The sections 32, once loaded, are stacked and interconnected. The outer tubular wall 36 of each section serves to protect the shaped charge(s) inside.

A connector assembly 38 can be used to connect a stack of sections 32 together. For example, FIG. 5, shows schematically several possible connector assemblies. It is understood that the shown assemblies are not detailed or exclusive, but convey potential manners of providing connections. One potential form of connector assembly 40 has an end-cap 42 and a connector rod 44 which extends longitudinally through and connects to multiple sections. Alternately, a potential form of connector assembly 46 has an end-cap 48 and multiple connecting members, such as shaped rods 50 which interlock or cooperate with features, such as grooves 52, on the sections. Alternately, the sections could simply lock together using an interlocking mechanism known in the art, such as interlocking portions 54 and 56, mechanical latches 58, cooperating threads, etc. These connector assemblies are exemplary only and those of skill in the art will recognize various methods for connecting adjacent sections. If desired, intermediate sections 60 can be used between adjacent sections. The use of these individualized sections would require significantly smaller metallic glass pieces to be manufactured to create the gun.

Metallic glass alloys (or amorphous metal) are metallic material with a disordered atomic-scale structure. In contrast to most metals, which are crystalline and therefore have a highly ordered arrangement of atoms, metallic glass alloys are non-crystalline. There are several ways to produce metallic glass alloys, which include extremely rapid cooling, physical vapor deposition, solid-state reaction, ion irradiation, melt spinning, and mechanical alloying. These alloys can be manufactured from one or multiple metals and chemical elements such as iron, copper, palladium, lead, antimony, lanthanum, magnesium, zirconium, palladium, iron, copper, and titanium.

Metallic glass alloys have a variety of potentially useful properties. In particular, they tend to be stronger than crystalline alloys of similar chemical composition. The strength of a crystalline metal is limited by the presence of defects in the crystalline structure called dislocations. A metallic glass alloy has no crystalline structure and no dislocations, and so its strength can approach the theoretical limit associated with the strength of its atomic bonds. One modern metallic glass alloys, known as Vitreloy, has a tensile strength that is almost twice that of high-grade titanium. On the other hand, metallic glasses are not ductile and tend to fail suddenly when loaded in tension.

The table below presents a comparison of the mechanical properties of some metallic glasses, along with a few conventional alloys for comparison:

| Alloy | Yield Strength MPa | Yield Strength ksi | Density g/cm$^3$ | Density lb/in$^3$ | Strength to weight ratio | Elongation (%) |
|---|---|---|---|---|---|---|
| Metallic Glasses | | | | | | |
| $Zr_{41.25}Ti_{13.75}Ni_{10}Cu_{12.5}Be_{22.5}$ | 1900 | 275 | 6.1 | 0.22 | 310 | 2* |
| $Mg_{65}Cu_{25}Tb_{10}$ | 700 | 100 | 4.0 | 0.14 | 175 | 1.5* |
| $Fe_{59}Cr_6Mo_{14}C_{15}B_6$ | 3800 | 550 | 7.9 | 0.29 | 480 | ~2* |
| Conventional Alloys | | | | | | |
| Aluminum (7075) | 505 | 73 | 2.8 | 0.10 | 180 | 11 |
| Titanium (Ti-6AL-4V) | 1100 | 160 | 4.4 | 0.16 | 250 | 10 |
| Steel (4340) | 1620 | 190 | 7.9 | 0.29 | 206 | 6 |
| Magnesium (AZ80) | 275 | 400 | 1.8 | 0.07 | 150 | 7 |

*fails abruptly without plastic (permanent) deformation

We can see from the table that metallic glasses can in fact be quite strong, For instance, iron-based glass in the table ($Fe_{59}Cr_6Mo_{14}C_{15}B_6$) is more than twice as strong as a high-strength steel (550 ksi vs. 190 ksi), while its plastic elongation (a measure of ductility) is three times smaller (about 2% compared to 6%), which means it is substantially more brittle.

The invention differs from earlier attempts to solve the same problem because it uses metallic glass alloys for the gun carrier. Previous attempts have been made to solve the same problem using materials such as carbon fibers, glass fibers, or combinations thereof. U.S. Pat. No. 5,960,894, to Lilly, discloses the use of commercially available polyacrylonitrile (PAN) or pitch-based carbon fibers. It also describes the use E- or S-glass fibers. However, those materials do not sufficiently withstand the high-pressure and high-temperature environmental conditions typically encountered in a well and do not tend to shatter into pieces small enough to accomplish the objective of the design.

Additional embodiments of potential expendable TCPs are described below. These apparatus and methods of use differ from the description above regarding use of metallic glass alloy materials.

Following are descriptions of several apparatus and methods for providing a disappearing perforating gun assembly. The term "dematerialize" is used herein to collectively refer to the various processes which result in the "disappearance" of the perforating assembly or portions thereof; the term is inclusive, but not limited to, dissolving, melting, chemically reacting, fragmenting into small enough pieces to meet the purposes of the invention, decomposing, combusting, and corroding.

First described are embodiments directed to decomposing or corroding the outer tubular.

Figure 6:
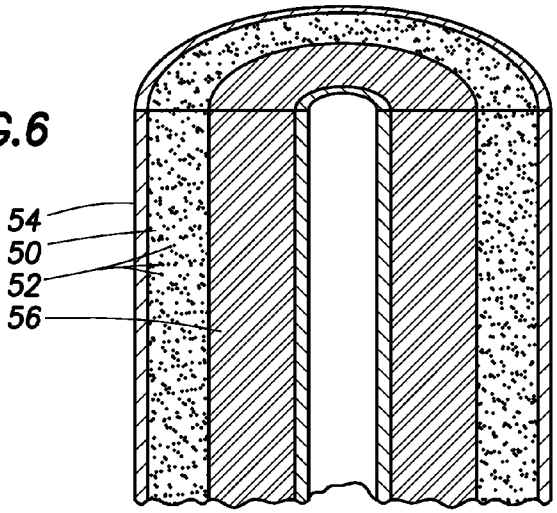
FIG. 6 is an elevational and cross-sectional view of an embodiment of a gun carrier according to an aspect of the invention.

In one embodiment, as seen in FIG. 6, a corroding outer tubular 50 is presented in cross-section. The outer tubular is made of a material that corrodes fairly rapidly in a downhole environment but has the strength to perform as a carrier body. For example, aluminum can be used. In a preferred embodiment, a relatively more corrosive material 52 is included in the outer tubular such that upon exposure to downhole fluids, as the outer tubular corrodes, the material accelerates overall corrosion. In a preferred embodiment, a liner 54 is provided to prohibit or slow corrosion long enough to perform the task of perforating the well. In yet another preferred embodiment, an inner support layer 56 is provided. The inner support layer can allow the outer tubular to have a thinner wall since the support layer provides radial support for the tubular. The inner support layer can be epoxy, rubber, sand, or other material (shown as rubber). The inner support layer is shown as completely filling the space between the outer tubular and the inner structure 58, although this need not be the case. (Explosive charges are omitted from the Figures to simplify discussion.) Combinations of the described embodiments are possible.

Figure 7:
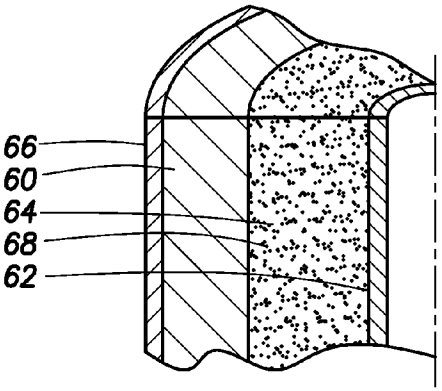
FIG. 7 is a simplified cross-sectional break-away of an embodiment of the invention.

FIG. 7 is a simplified cross-sectional break-away of an embodiment of the invention. In FIG. 7, the annular space between the outer tubular 60 and inner structure 62 is filled with a substance 64 which enhances decomposition of the tubular. In a preferred embodiment, the substance is an acid powder or basic powder. In a preferred embodiment, the substance within the gun reacts with the fluids outside of the gun in order to decompose the gun. One method for accomplishing this would be to have a solid powdered acid or base material within the gun, such as sodium hydrogen sulfate. Alternately, other acid salts or alkali salts can be used, such as sodium bicarbonate, sodium hydrosulfide, monosodium phosphate, disodium phosphate, sodium sulfide, potassium cyanide, etc. These chemicals dissolve in wellbore fluids and change the pH of the fluids to either a strong acid or a strong base. The pH-altered fluid in the wellbore attacks the tubular through corrosion or galvanic reaction with a dissimilar metal.

Figure 8:
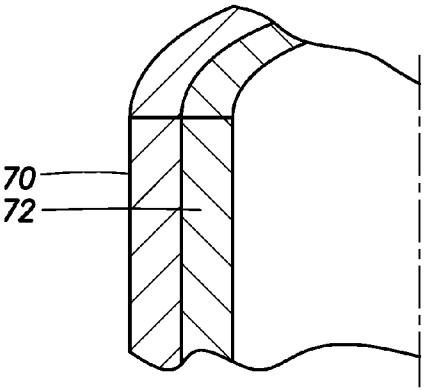
FIG. 8 is a simplified cross-sectional break-away of an embodiment of the invention.

With continued reference to FIG. 7, in another preferred embodiment, the outer tubular 60 is made of a material which is known to corrode. FIG. 7 (among others) is used to illustrate multiple embodiments in a single FIGURE to reduce the number of figures and for ease of reference. A preferred corroding material is PLA (polylactic acid), which dissolves over time. A coating 66 or exterior liner may be needed to delay the disintegration until the guns fire. The interior of the gun carrier can be filled with a sand-salt matrix 68. The wall of the gun can be reduced to a thin wall since the sand-salt matrix (or other filler) provides structural support for the outer tubular. Such a thin wall can be a thin layer of metal or other material. The sand-salt provides high compressive strength to prevent the thin wall from collapsing. After the guns fire, the outer tubular is breached and wellbore fluids dissolve the salt, allowing the sand to disappear into the rathole. In the preferred embodiment, the wall of the gun is a PLA material so that everything disappears. In this embodiment, the strength component (radial load bearing) of the gun is a material that will be dissolved/decomposed by the wellbore fluids and that a weak housing (thin metal) or a dissolvable housing (PLA) is used to delay the decomposition of that strength component. In another FIG. 8 is a simplified cross-sectional break-away of an embodiment of the invention. The housing of the gun carrier has two metals layers 70 and 72. The metals galvanically react with each other and cause their mutual destruction. For example, the exterior of the housing could be thin steel while the interior is magnesium. When exposed to the wellbore fluids upon perforation of both layers by the shaped charges, the magnesium layer 72 will be reduced by the steel layer 70 and be dissolved into the formation brine as magnesium hydroxide. The steel and magnesium are exemplary materials; those of skill in the art will recognize other combinations. In another embodiment, the gun housing would have an outer tubular 74 of zinc, magnesium or similar type metal-based material. The housing disappears as the material is consumed or "burned up" in the explosive detonation. In another embodiment, a liner 76, positioned inside the tubular reacts in response to the explosion and subjects the tubular to sufficient forces to cause break-up. The reactive material could be a metal based material such as zinc or magnesium or a more volatile material such as ammonium perchlorate propellant.

Following are methods and apparatus for a "disappearing" gun with dissolving or melting components.

Figure 9:
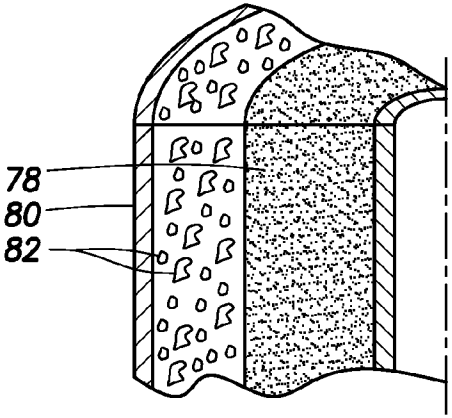
FIG. 9 is a simplified cross-sectional break-away illustrating additional embodiments of the invention.

FIG. 9 is a simplified cross-sectional break-away illustrating additional embodiments of the invention. The interior space 78 of the gun carrier contains thermite or some other material with a high exothermic reaction. Firing the explosive charges initiates a thermite reaction. Heat from the thermite melts the gun housing outer tubular 80. In a preferred embodiment, the tubular 80 is a composite material that contains modules of reactive material 82. Firing the guns initiates the reactive material within the outer tubular 80. The reactive material enhances destruction of the gun. In another embodiment, the outer tubular 80 is one component of the thermite reaction (such as aluminum) and the second component 78 of the thermite reaction (such as iron oxide or copper oxide) is positioned within the outer tubular 80. Again, the firing of the charges results in a chemical reaction. The outer tubular of the gun housing could be a plastic, like PEEK, that melts at a relatively low temperature. The thermite reaction occurs at approximately 2500 degrees Celsius, which greatly exceeds the melting temperature of PEEK. The result is that the heat from the thermite reaction causes melting or disintegration of the housing.

Figure 10:
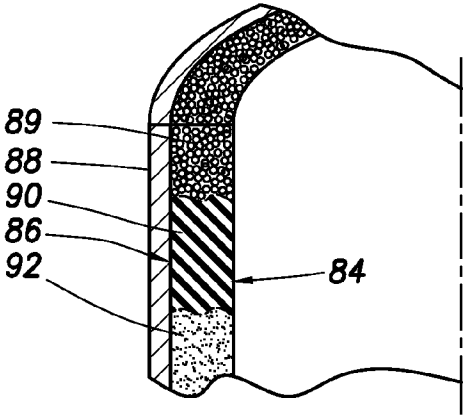
FIG. 10 is a simplified cross-sectional break-away of a preferred embodiment of the invention.

FIG. 10 is a simplified cross-sectional break-away of a preferred embodiment of the invention. The annular layer 84 is made up of a mixture of materials, at least one of which is a material that degrades in the presence of hydrocarbon fluids, such as Styrofoam (trade name) seen at 89, natural rubber, seen at 90, or other material. (The Figure is a schematic indicating the material types which can be mixed into the other materials, such as plastic, metal, etc., making up the outer tubular.) Preferably the material dissolves in hydrocarbon fluid. Alternately, a fluid can be pumped downhole after detonation to dissolve the material. As the material degrades, the tubular 86 crumbles. A protective layer 88 can be employed to delay degradation until after firing of the charges. The barrier can be a non-corrosive sheet of metal or other material, where degradation of the outer tubular is delayed until after perforation, or a coating or layer of material which corrodes or degrades at a slower rate than the material of the outer tubular. Additionally, a natural rubber 90 that degrades in hydrocarbon environments could be used as a temporary protective coating or a partial structural element. In another embodiment, a coating 88 on the outer tubular is provided, as described above, and the outer tubular is at least partially made of chalk 92, such as a component or element in a mixture which forms the tubular. In this embodiment, after the charges are fired, HCL can be pumped into the wellbore to dissolve the gun carrier.

The following are embodiments to fragment the gun carrier outer tubular.

Figure 11:
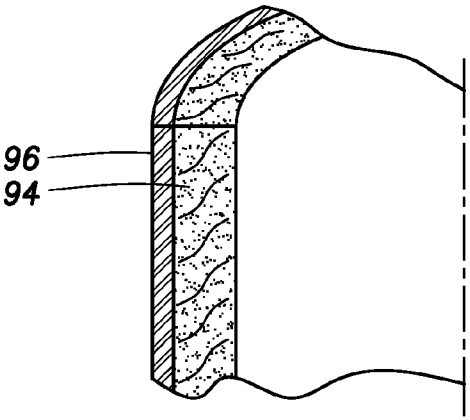
FIG. 11 is a simplified cross-sectional break-away of a preferred embodiment of the invention.

FIG. 11 presents an outer tubular 94 made of powdered metal. This system would be prone to leak, so a barrier or membrane 96 can be used to prevent fluid entry. The barrier can be a thin metal sheet or a protective coating, for example. Unique features may be included to: increase strength, increase sealing capabilities, increase ability to break-up, create specific patterns of broken pieces, and/or increase charge performance. These features may be accomplished through one or more of the following: combination of materials used with specific properties to drive a specific feature, layering of materials (axially and/or radially), and varying compressive loads applied.

In another preferred embodiment, the gun carrier is made from a ceramic material which provides mechanical properties to survive deployment into the well but easily breaks-up or shatters during the explosive detonation. The ceramic material would have brittle characteristics that cause shattering during a perforation event.

Figure 12:
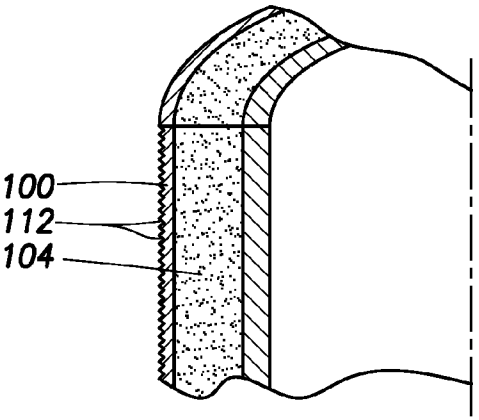
FIG. 12 is a simplified cross-sectional break-away view of exemplary embodiments of the invention.

FIG. 12 is a simplified cross-sectional break-away view of exemplary embodiments of the invention. Using a standard steel gun carrier 100 or equivalent, grooves 102 or similar feature are machined, scarred, pressed or equivalent into the OD or ID of the carrier. These grooves provide a pattern in which the material fractures upon detonation of the perforating charges, similar to a pineapple hand-grenade. In another embodiment, a chemical reaction within the interior of the gun housing can increase the internal pressure of the housing, which would facilitate the controlled fragmentation of the gun housing. For example, a time delayed secondary detonation could be used to fragment the gun once the initial gun firing had cause the gun body to be filled with fluid. In another embodiment, a "grenade" outer tubular 100 is used in conjunction with sand and/or salt material 104. Using a process discussed above, the carrier is filled with sand and/or salt material 104. As the detonation initiates, there is tremendous gas pressure that builds internal to the outer tubular. The internal free volume is used to allow the pressure to build but not rupture the carrier. In this configuration, the sand/salt material or equivalent fills the free volume of the carrier and, as a result, causes the internal gun pressure to increase beyond the yield strength of the carrier, thus causing the carrier to rupture. In another preferred embodiment, the grenade concept is combined with directional cutters. The system is loaded two types of explosive devices: the perforation shaped charges and one or more segmented cutter explosive devices (or equivalent). The segmented cutters are preferably aligned with machined "weak points" (such as grooves) in the carrier, thus allowing the carrier to break-up upon detonation.

Figure 13:
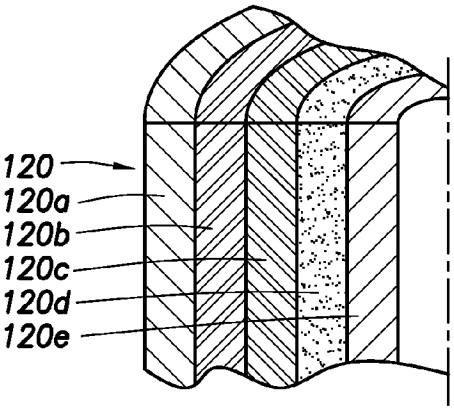
FIG. 13 is a cross-sectional partial view of a preferred embodiment of the invention.

FIG. 13 is a cross-sectional partial view of a preferred embodiment of the invention. The gun carrier is a layered composite. The carrier wall 120 is comprised of non-bonded layers of composite material 120*a-e*, such that the layers provide structural support for each other. However, since the layers are non-bonded, they will better break into small pieces upon detonation of the charges. One or more of the non-bonding layers could be explosive material, such as stim-gun explosive material, that would enhance destruction of the gun housing. The layers 120*a-e* can be plastic, fiberglass, etc., which provide structural integrity alone or when cooperatively reinforced by the additional layers. At least some of the layers are of a non-binding material, such that upon detonation of the charges, the various layers will separate. Consequently, the tubular will tend to break-up into smaller pieces than a similar non-layered composite tubular wall.

Figure 14:
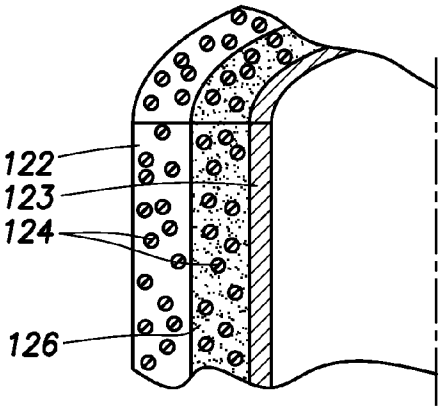
FIG. 14 is a cross-sectional partial view of another embodiment of the invention.

FIG. 14 is a cross-sectional partial view of another embodiment of the invention. In this embodiment, the gun body outer tubular 122 or the inner charge-holder structure 123 (or both) have energetic materials 124 (propellants or explosives) imbedded into their structures that would serve to break-up the carrier once the perforation charges are fired. This energetic material could also be positioned, for example, in the form of propellant beads, mixed with sand 126 or other inert materials and stored inside the gun body.

The following described methods for collapsing or reducing the housing of the perforating gun assembly.

Figure 15:
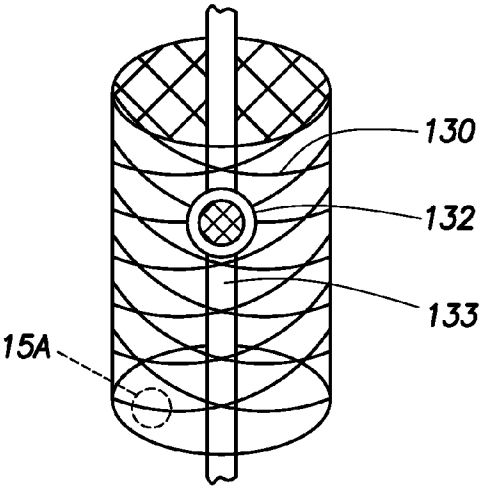
FIG. 15 is an elevational schematic view of an embodiment of the invention.
Figure 15A:
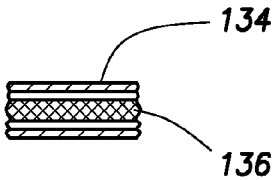
FIG. 15A is a detail of FIG. 15 according to an aspect of the invention.

FIG. 15 is an elevational schematic view of an embodiment of the invention. A strip type gun having a wire frame is presented. This gun carrier system uses an external wire frame 130 to support the charges 132 attached to the deployment strip 133. The wire frame can be made up of small tubes 134 with det cord (Primacord) 136 on the inside, as seen in FIG. 15A. When the guns fire, the frame is destroyed and the system collapses. Alternatively, portions of the support structure could be placed directly in front of the perforating charge. When the charges fire, the support structure is destroyed.

In an additional embodiment, a strip-type gun design is used in conjunction with a retrievable carrier. A wireline type perforating system is employed having capsule charges loaded onto a deployment strip. Since the strip is not durable enough for TCP deployment techniques, a carrier or deployment housing covers the loaded strip during the trip in the well. After positioning at the correct well depth, the strip gun is released and the carrier is retrieved back to the surface. The resulting debris after detonation from the strip gun is substantially less than the traditional TCP carrier equipment remaining after detonation.

Further disclosure regarding strip type guns can be found at U.S. Pat. No. 5,662,178, to Shirley, filed on Mar. 29, 1996, which is hereby incorporated herein for all purposes.

Figure 16:
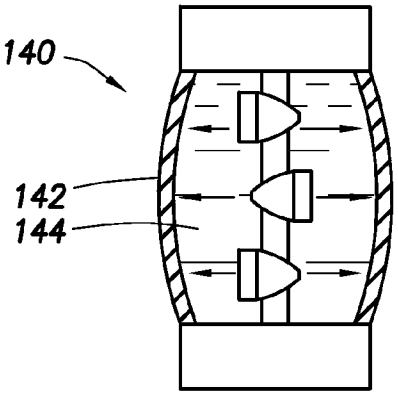
FIG. 16 is an elevational schematic view of another embodiment of the invention.

FIG. 16 is an elevational schematic view of another embodiment of the invention. The gun 140 is made like a balloon, having a flexible membrane or bladder 142 filled with fluid 144. The fluid 144 provides stiffness for the expandable layer 142 during surface handling. In a preferred embodiment, a gelled fluid 144 is a solid at surface temperatures. In the wellbore, the fluid melts and expands. The internal pressure created by the fluid, indicated by arrows, will stiffen the balloon-like housing. As an analogy, this is similar to air-supported domes which, when inflated, provide a rigid structure. When the dome is deflated, the entire structure collapses. The inflated gun carrier is stiff until the charges perforate the housing and then the gun carrier deflates.

Figure 17:
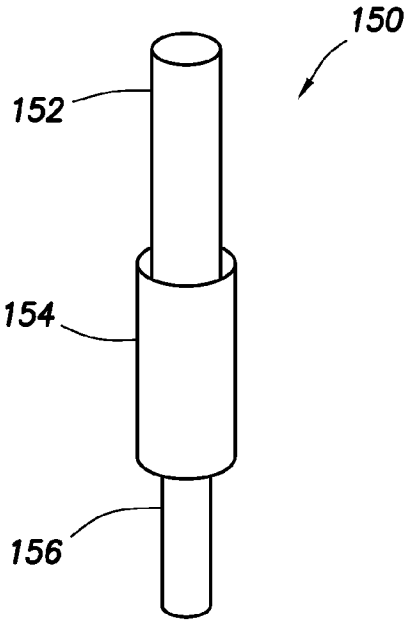
FIG. 17 is an elevational schematic view of an embodiment of the invention.

FIG. 17 is an elevational schematic view of an embodiment of the invention. A telescoping gun is presented. The gun system 150 uses different sized carriers 152, 154, 156, which can telescope or collapse together. The guns (and/or intervening spacers) are a series of bigger and smaller carriers, alternating in size or sequentially smaller, etc.

Figure 18:
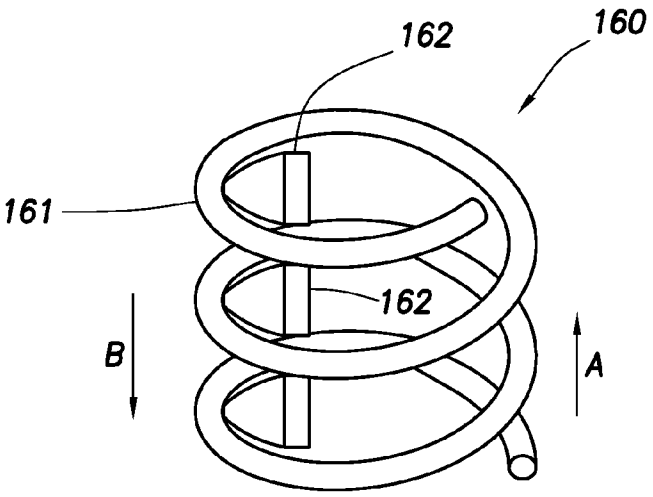
FIG. 18 is an elevational schematic view of an embodiment of the invention.

FIG. 18 is an elevational schematic view of an embodiment of the invention. A coil-shaped, "spring" gun 160 is presented. The gun carrier 160 is in the form of a coil spring, upon which are positioned a plurality of shaped charges 162. Alternately, a separate inner structure can support the shaped charges. When the charges fire, the coiled carrier is allowed to collapse to a "solid height" shape, as indicated by arrow A. The shorter coil will use less space in the rathole, if dropped into the wellbore. Alternatively, the coil could be allowed to elongate after perforation, as indicated by arrow B. The gun can then be pulled from the well with reduced risk of damaging the well, as the now-elongated coil has a reduced diameter and will more easily fit through the production packer and tubing.

The methods and apparatus discussed with respect to the outer tubular may also or alternately be used in regard to the inner structure.

An additional method would use a delay-effect to create an aftershock or sustained shock after the perforation event. The delayed initiation detonates a second train of explosives with the sole purpose of creating specific forces to break-up the perforator assembly and/or its constituent parts.

An additional method is to make the outer tubular of cast iron which has relatively little elongation. The lower elongation should result in break-up into smaller pieces. Further, additional det cord or a later-fired det cord (after the perforating event) can be used. The delayed det cord initiation would enhance destruction, since by that time the carrier body is filled with fluid. The secondary explosion would consequently create great pressure on the carrier.

A method of perforating a well casing, comprising the steps of: inserting into the well casing a tubing conveyed perforator having an outer tubular made from a metallic glass alloy having high strength and low impact resistance, and an inner structure positioned within the outer tubular and holding one or more explosive charges; detonating the one or more explosive charges; and fragmenting the outer tubular upon detonation of the one or more explosive charges. The method can further include steps: substantially destroying the inner structure upon detonation of the one or more explosive charges; wherein the inner structure is made from a combustible material, and further comprising the step of combustibly destroying the inner structure; wherein the inner structure is made from a corrosive material, and further comprising the step of corroding the inner structure; wherein the inner structure is made from a dissolvable material, and further comprising the step of dissolving the inner structure; and wherein the tubing conveyed perforator further comprises a disintegration-enhancing material positioned between the outer tubular and the inner structure. The disintegration-enhancing tube is made from a material selected from the group consisting of nitrocellulose, wood cellulose, cardboard, fiberboard, thermoplastic, thermoset resin, structural foam, and combinations thereof. The disintegration enhancing material can be a solid, liquid, gel, or a plurality of loose particles (such as sand). The metallic glass alloy is selected from the group consisting of $Zr_{41.25}$ $Ti_{13.75}$ $Ni_{10}$ $Cu_{12.5}$ $Be_{22.5}$, $Mg_{65}$ $Cu_{25}$ $Tb_{10}$, *and* $Fe_{59}$ $Cr_6$ $Mo_{14}$ $C_{15}$ $B_6$. A protective coating can be used on the exterior of the outer tubular.

Disclosure regarding methods for actuating firing heads and types of differential firing heads can be found in the following references, which are each incorporated herein by reference for all purposes: U.S. Pat. No. 5,301,755, to George; U.S. Pat. No. 4,917,189, to George; U.S. Pat. No. 5,161,616, to Colla; U.S. Pat. No. 4,566,544 to Bagley; U.S. Pat. No. 4,616,718 to Gambertoglio; and U.S. Pat. No. 5,297,718 to Barrington. Disclosure regarding the use of tubing-conveyed perforators can be found in the following references, which are hereby incorporated herein by reference for all purposes: U.S. Pat. No. 5,960,894, to Lilly, entitled Expendable tubing conveyed perforator; U.S. Pat. No. 6,422,148, to Xu, entitled Impermeable and composite perforating gun assembly; U.S. Pat. No. 5,477,785, to Dieman, Jr., entitled Well pipe perforating gun; U.S. Pat. No. 4,905,759, to Wesson, entitled Collapsible gun assembly; U.S. Pat. No. 4,467,878, to Ibsen, entitled Shaped charge and carrier assembly therefor; and International Patent Publication WO2005/035940A1, to Meddes, entitled Improvements in and relating to perforators.

Further disclosure regarding shaped-charges, perforation assemblies, etc., can be found in the following references which are hereby incorporated in their entirety for all purposes: U.S. Pat. No. 3,589,453 to Venghiattis, U.S. Pat. No. 4,185,702 to Bullard, U.S. Pat. No. 5,449,039 to Hartley, U.S. Pat. No. 6,557,636 to Cernocky, U.S. Pat. No. 6,675,893 to Lund, U.S. Pat. No. 7,195,066 to Sukup, U.S. Pat. No. 7,360,587 to Walker, U.S. Pat. No. 7,753,121 to Whitsitt, and U.S. Pat. No. 7,997,353 to Ochoa; and U.S. Patent Application Publication Nos. 2007/0256826 to Cecarelli, 2010/0300750 to Hales, and 2010/0276136 to Evans. Various arrangements of shaped-charges may be employed.

Presented are several methods. A method of perforating a well casing, comprising the steps of: inserting into the well casing a tubing conveyed perforator having an outer tubular made from a metallic glass alloy having high strength and low impact resistance, and an inner structure positioned within the outer tubular and holding one or more explosive charges; detonating the one or more explosive charges; and fragmenting the outer tubular upon detonation of the one or more explosive charges. The same method can comprise additional steps and details: substantially destroying the inner structure upon detonation of the one or more explosive charges; wherein the inner structure is made from a combustible material, and further comprising the step of combustibly destroying the inner structure; wherein the inner structure is a tubular having a plurality of holes therein for supporting the one or more explosive charges; wherein the inner structure is made from a corrosive material, and further comprising the step of corroding the inner structure; wherein the inner structure is made from a dissolvable material, and further comprising the step of dissolving the inner structure; wherein the tubing conveyed perforator further comprises a disintegration-enhancing material positioned between the outer tubular and the inner structure; wherein the disintegration-enhancing material is chemically reactive with the outer tubular; and/or wherein the outer tubular further comprises a protective coating on its exterior surface.

A further method is presented. A method of perforating a well casing, comprising the steps of: inserting into the well casing a tubing conveyed perforator having an outer tubular member and an inner structure positioned within the outer tubular, the inner structure supporting one or more explosive charges; detonating the one or more explosive charges; and dematerializing the outer tubular upon detonation of the one or more explosive charges. The same method can include additional steps and details: dematerializing further comprises substantially corroding the outer tubular member; wherein the outer tubular member is made of aluminum; wherein the step of corroding further comprises corroding the outer tubular member with wellbore fluids; wherein the step of corroding further comprises the step of pumping a corrosive fluid into the well; further comprising the step of delaying the corroding of the outer tubular member for a selected period; wherein the step of delaying further comprises the step of corroding a protective layer of material exterior to the outer tubular member; wherein the outer tubular member is made of a corrosive material with inclusions of relatively more corrosive material; wherein the step of dematerializing further comprises the step of reacting a material carried interior to the outer tubular member with wellbore fluids; further comprising the step of altering the pH of the wellbore fluid, and further comprising the step of dematerializing the outer tubular member using the pH-altered fluid; wherein the material carried interior to the outer tubular member is a powdered acidic or basic material; wherein the step of dematerializing further comprises substantially corroding the outer tubular member; further comprising dematerializing a delay layer positioned exterior to the outer tubular member; wherein the tubing conveyed perforator further has an interior space defined between the outer tubular member and the inner structure, and wherein the interior space is positioned at least one interior material; wherein the interior material is a sand-salt matrix; further comprising the step of providing structural support to the outer tubular member with the interior material; wherein the outer tubular member is a thin layer of metal; wherein the step of reacting further comprises reacting the material carried interior of the outer tubular member with a material of the outer tubular member; wherein the step of reacting further comprises reacting the material carried interior to the outer tubular member and a material of the outer tubular member in the presence of wellbore fluid or fluid pumped downhole; wherein the step of dematerializing further comprises the step of consuming the outer tubular member or an interior liner in response to detonation of the charges; wherein the outer tubular member or the interior layer is made at least partly of zinc or magnesium; wherein the outer tubular member or the interior layer is made at least partly of propellant; wherein the step of dematerializing further comprises the step of dissolving or melting the outer tubular member; wherein the step of melting further comprises melting the outer tubular member in response to a thermite reaction initiated by the detonation of the charges; wherein the outer tubular member is made of or contains a substance used in the thermite reaction; wherein an interior layer is made of a material used in the thermite reaction; wherein the outer tubular member is made of a plastic material; wherein the step of dematerializing further comprises the step of dissolving at least one material of a mixture of materials forming the outer tubular member; wherein the at least one material dissolves in hydrocarbon fluid; wherein another of the materials of the mixture is a metal; wherein the step of dematerializing further comprises fragmenting the outer tubular member; wherein the outer tubular member is comprised of metallic glass alloy, powdered metal, or ceramic; wherein the outer tubular member is made up of a plurality of layers of material, including at least one layer made of non-bonded material; wherein the outer tubular member has energetic material imbedded therein; and/or wherein interior of the outer tubular member is a mixture of energetic material and inert material.

A further method is presented. A method of perforating a well casing positioned downhole in a well, comprising the steps of: inserting into the well casing a tubing conveyed perforator having an outer tubular member and an inner structure positioned within the outer tubular, the inner structure holding one or more explosive charges, and a support structure without which the outer tubular member would collapse after insertion into the well; detonating the one or more explosive charges; damaging the support structure in response to the detonation; and collapsing the outer tubular in response to damaging the support structure. The method can further include additional steps and details: further comprising damaging a wire frame support structure positioned exterior to the charges; further comprising combusting detonation cord attached to the wire frame support structure; wherein the step of collapsing further includes the step of telescoping adjacent segments of outer tubular members; wherein the step of collapsing further includes the step of elongating or shortening a coiled spring-like member of the support structure; wherein the support structure is an expandable fluid filling the interior of the outer tubular member, wherein the outer tubular member is an expandable membrane capable of sealing the expandable fluid therein; and/or wherein the expandable fluid is a gel at surface temperature and pressure.

Persons of skill in the art will recognize various combinations and orders of the above described steps and details of the methods presented herein.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

It is claimed:

1. A method of perforating a well casing, the method comprising:

inserting, into the well casing, a tubing conveyed perforator comprising:

an outer tubular made from a plurality of non-bonded metallic glass alloy tubulars having high strength and low impact resistance, and an inner structure positioned within the outer tubular and holding one or more explosive charges;

detonating the one or more explosive charges; and fragmenting the outer tubular upon detonation of the one or more explosive charges.

2. The method of claim 1, further comprising substantially destroying the inner structure upon detonation of the one or more explosive charges.

3. The method of claim 2, wherein the inner structure is made from a combustible material, a corrodible material, or a dissolvable material.

4. The method of claim 1, wherein the metallic glass alloy is selected from the group consisting of $Zr_{41.25}Ti_{13.75}Ni_{10}Cu_{12.5}Be_{22.5}$, $Mg_{65}Cu_{25}Tb_{10}$, and $Fe_{59}Cr_{6}Mo_{14}C_{15}B_{6}$.

5. The method of claim 1, wherein the tubing conveyed perforator further comprises a disintegration-enhancing material positioned between the outer tubular and the inner structure.

6. The method of claim 5, wherein the disintegration-enhancing material is selected from nitrocellulose, wood cellulose, cardboard, fiberboard, thermoplastic, thermoset resin, structural foam, and combinations thereof.

7. The method of claim 5, wherein the disintegration-enhancing material is chemically reactive with the outer tubular.

8. The method of claim 1, further comprising creating the outer tubular member by stacking a plurality of tubulars made of metallic glass alloy.

9. An expendable tubing conveyed perforator, comprising:

an outer tubular made from a metallic glass material having high strength and low impact resistance;

an inner structure positioned within the outer tubular configured to hold one or more explosive charges; and wherein the outer tubular comprises two metal layers configured to galvanically react with each other.

10. The perforator of claim 9, wherein the outer tubular comprises a metallic glass alloy.

11. The perforator of claim 9, wherein the inner structure is made from a combustible material, dissolvable material, or corrodible material, selected to dematerialize upon detonation of the one or more explosive charges.

12. The perforator of claim 9, further comprising a disintegration-enhancing material positioned between the outer tubular and the inner structure.

13. A method of perforating a well casing, the method comprising:

inserting into the well casing a tubing conveyed perforator comprising an outer tubular member at least partially formed from at least one non-bonded metallic glass alloy and an inner structure positioned within the outer tubular, the inner structure supporting one or more explosive charges;

detonating the one or more explosive charges; and dematerializing a substantial portion of the outer tubular member upon detonation of the one or more explosive charges.

14. The method of claim 13, wherein dematerializing further comprises substantially corroding the outer tubular member using a corrosive carried in an in situ wellbore fluid, a fluid pumped downhole, or a fluid altered by addition of a substance downhole.

15. The method of claim 14, further comprising delaying the substantially corroding of the outer tubular member for a period of time.

16. The method of claim 15, wherein delaying further comprises corroding a protective layer of material exterior to the outer tubular member.

17. The method of claim 13, wherein dematerializing further comprises reacting a material carried interior to the outer tubular member or a material of the outer tubular member using in situ wellbore fluids, fluids pumped downhole, or fluids altered by pumping an altering substance downhole.

18. The method of claim 13, wherein the tubing conveyed perforator further comprises an interior space defined between the outer tubular member and the inner structure, wherein at least one interior material is positioned in the interior space.

19. The method of claim 18, further comprising providing structural support to the outer tubular member with the at least one interior material.

20. The method of claim 13, wherein dematerializing further comprises consuming the outer tubular member or an interior liner in response to detonation of the charges.

21. The method of claim 20, wherein the outer tubular member or the interior layer is made at least partly made of zinc, magnesium, or propellent.

22. The method of claim 13, wherein dematerializing further comprises melting at least a portion of the outer tubular member.

23. The method of claim 22, wherein melting further comprises initiating a thermite reaction, wherein at least a portion of the outer tubular member or at least a portion of a material positioned interior to the outer tubular member is used in the thermite reaction.

24. The method of claim 13, wherein dematerializing further dissolving at least one material of a mixture of materials forming the outer tubular member.

25. The method of claim 13, wherein the outer tubular member comprises layers of materials, a mixture of materials, or a mix of materials.

* * * * *